United States Patent [19]

Prahauser et al.

[11] Patent Number: 4,838,167

[45] Date of Patent: Jun. 13, 1989

[54] METHOD AND DEVICE FOR PROTECTION OF TARGETS AGAINST APPROACHING PROJECTILES, WHICH PROJECTILES ARE PROVIDED WITH INFRARED-SENSITIVE TARGET FINDERS

[75] Inventors: Georg Prahauser, Oberalm, Austria; Paul Huber, deceased, late of Unterjettenberg; Alois Schiessl, legal representative, Bad Reichenhall, all of Fed. Rep. of Germany

[73] Assignee: Firma Buck KG, Bad Uberkinged, Fed. Rep. of Germany

[21] Appl. No.: 921,581

[22] Filed: Jun. 16, 1978

Related U.S. Application Data

[63] Continuation-in-part of Ser. No. 525,284, Nov. 15, 1974, abandoned.

[51] Int. Cl.[4] ..... F42B 13/00

[52] U.S. Cl. ..... 102/334; 102/505; 250/495.1

[58] Field of Search ..... 102/87, 89, 90, 66, 102/6, 65, 34.4, 37.6, 334, 364, 367, 505; 343/18 E; 250/338, 342, 493, 495, 495.1, 338.1, 493.1; 149/2, 3, 5, 7, 11, 16, 19.91, 37

[56] References Cited

U.S. PATENT DOCUMENTS

| | | | |
|---|---|---|---|
| 1,175,800 | 3/1916 | Nixon | 102/66 |
| 1,771,455 | 7/1930 | Wiley | 102/66 X |
| 2,476,302 | 7/1949 | Jeppson | 102/34.4 |
| 2,558,726 | 7/1951 | Barker | 102/90 |
| 2,775,938 | 1/1957 | Wade | 102/66 X |
| 3,095,814 | 7/1963 | Jansen et al. | 102/37.6 X |
| 3,150,848 | 9/1964 | Lager | 244/316 |
| 3,155,749 | 11/1964 | Rossen et al. . | |
| 3,611,936 | 10/1971 | Bouisse et al. | 102/87 |
| 3,674,174 | 7/1972 | Crewe | 343/18 E |
| 3,841,219 | 10/1974 | Schillreff | 343/18 E |
| 3,899,975 | 8/1975 | Laurence | 102/89 |

FOREIGN PATENT DOCUMENTS

| | | | |
|---|---|---|---|
| 85741 | 10/1919 | Switzerland | 102/66 |
| 104944 | 3/1917 | United Kingdom | 102/66 |

*Primary Examiner*—Harold J. Tudor

*Attorney, Agent, or Firm*—Burns, Doane, Swecker & Mathis

[57] ABSTRACT

A method suitable for protecting targets against attacking projectiles as rockets consist in producing an infrared jamming radiator which radiator jams the infrared target finder of the attacking projectile. The jamming radiator is produced in the vicinity of the target and may be embodied by a jammer cloud consisting of burning particles, preferably foil strips, emitting an infrared radiation more intensive than the infrared radiation of the target and staying sufficiently long in the air as to divert the rocket from the target. The strips are stowed in a container which is emitted from the target and distributes the ignited strips into the airspace near the target.

9 Claims, 4 Drawing Sheets

METHOD AND DEVICE FOR PROTECTION OF TARGETS AGAINST APPROACHING PROJECTILES, WHICH PROJECTILES ARE PROVIDED WITH INFRARED-SENSITIVE TARGET FINDERS

This is a continuation-in-part of Ser. No. 525,284, filed Nov. 15, 1974, now abandoned.

BACKGROUND OF THE INVENTION

The invention relates to a method and a device for protection of targets against approaching projectiles, which projectiles are provided with infrared-sensitive target finders, especially for the protection of ships against approaching rockets.

After having succeeded in developing infrared detectors of very high sensitivity, today it is possible to equip projectiles, especially rockets, with infrared-sensitive target finders, which are sensitive to the infrared radiation which is emitted by the target, e.g. a ship. The known countermeasures against radar-controlled target finder fail in the case of infrared-controlled target finders. Therefore a lot of experiments were made to find special countermeasures against projectiles being equipped with infrared-controlled target finders. Until today no effective protection was found.

Basically there are imaginable two kinds of countermeasures. The first kind of countermeasure would be to prevent the infrared radiation emitted by the target from reaching the finder of the approaching rocket. The second kind of countermeasure would be to deflect the approaching rocket from the target. It is an object of this invention to find a method and a device by means of which it is possible to influence the infrared finder of a rocket approaching the target, which emits an infrared radiation, in such a way that the rocket is diverted from the target.

BRIEF SUMMARY OF A PREFERRED EMBODIMENT OF THE INVENTION

According to the invention—in case of the approach of such a projectile—there is produced an infrared jamming radiator in the airspace near the target, the radiator having the form of a jamming cloud, consisting of a plurality of burning particles floating or slowly sinking in the air, having such an intensity and/or dimension of infrared radiation so that it exceeds the infrared radiation of the target to be protected, and having a radiation duration being at least as long as the active detecting time of the infrared finder of the approaching projectile.

In other words there is produced an infrared jamming radiator in the neighbourhood of the attacked target, e.g. of an attacked ship, the intensity and/or dimension of this jamming radiator being such that the finder of the attacking rocket adjusts itself to this radiator and conducts the rocket to the location of the radiator, as a consequence of which the rocket is diverted from the ship. In this method according to the invention not only the intensity and the dimension of the jamming radiator are of importance but also the radiator duration of the jamming radiator, in order to be sure that the rocket remains adjusted to the jamming radiator until it has passed the target. In order to fulfil this condition the jamming radiator according to an embodiment of the invention is a jamming cloud consisting of burning particles, which particles are floating or sinking very slowly in the air and have a considerable burning duration.

Preferably the jamming cloud consists of a plurality of foil strips being coated at least on one side with a slowly burning substance. Such foil strips coated with an incendiary substance burn sufficiently long and stay in the air for a sufficient time period, so as to guarantee the requested radiation intensity and radiation duration. Previous attempts to produce a jamming cloud by spraying or distributing metal powder into the air successfully produced a powder cloud which would emit infrared radiation of high intensity. However, such powder particles burn for such a short period of time that they are an sales factory.

The coated foil strips of the present invention may consist of a material which is consumed together with the incendiary coating or of a material which is not consumed during the burning of the coating. In the latter case there results a storage of the radiation energy because the carrier strips are heated during the burning of the coating, whereby the infrared radiation is increased.

Preferably the cloud consisting of incendiary strips is produced by means of a projectile being emitted by the target. This projectile, after reaching a sufficient distance from the target, distributes the incendiary strips housed in the projectile. Preferably the moment of emission of the projectile is determined by an automatic projectile finder, with which ships and other targets are normally equipped.

Preferably the jamming projectile comprises a rocket composition and discharge containers containing the incendiary strips compactly stowed.

THE DRAWINGS

In order that the invention may be understood more clearly an embodiment thereof will now be described with reference to the accompanying drawings in which FIG. 1 is a schematial sketch explaining the principles of the invention;

THE DETAILED DESCRIPTION

Figure 1:
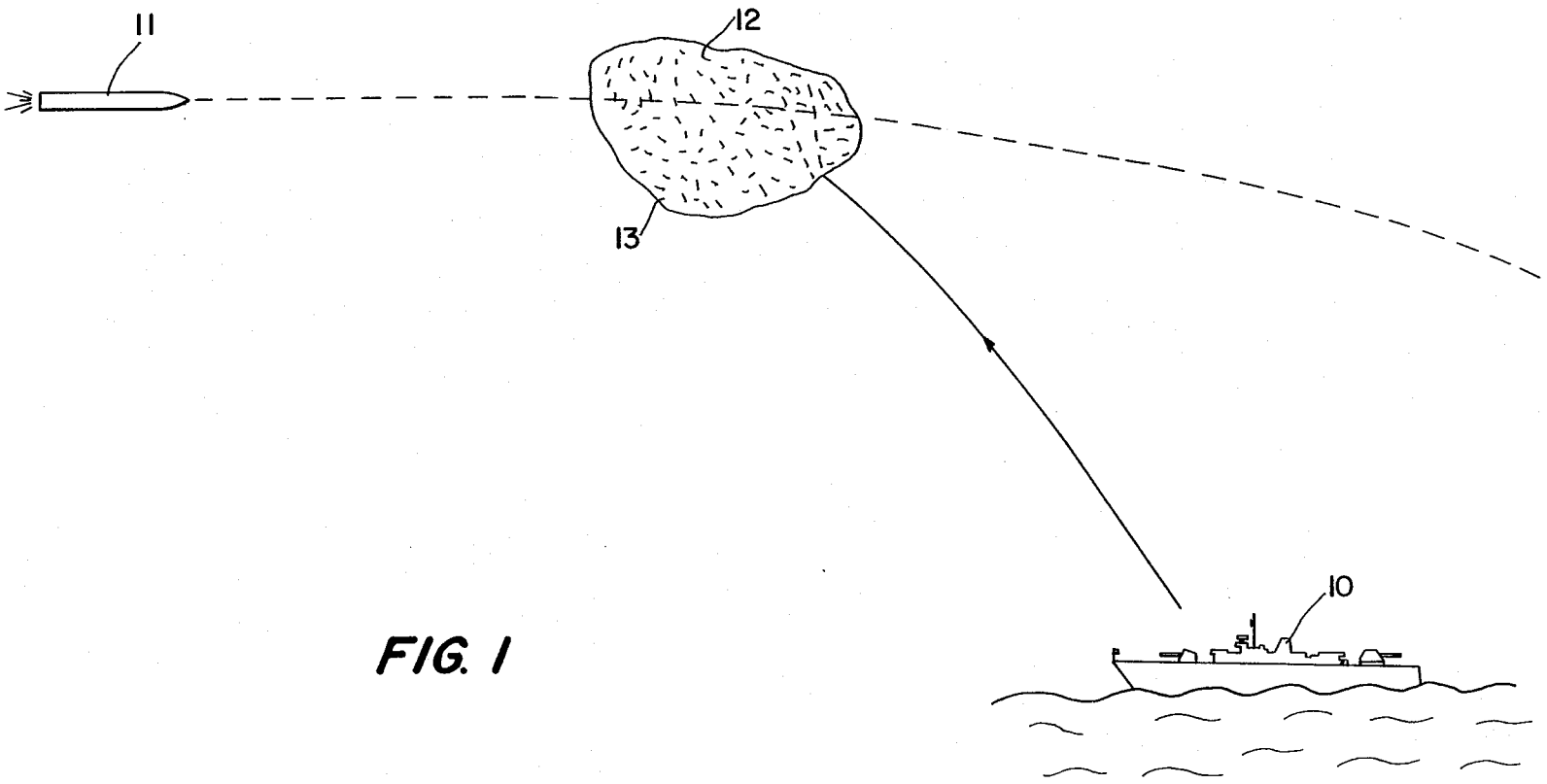

A schematical sketch of FIG. 1 shows a ship 10 being the target of the approaching rocket 11. The rocket 11 is provided with an automatical target position finder, which is sensitive to the infrared radiation being emitted from the ship 10. According to the invention the infrared radiation emitted by the ship 10 is exceeded by an infrared jamming radiator 12. Therefore the target position finder of the rocket 11 will not respond to the infrared radiation of the ship 10 but to the stronger infrared radiation of the jamming radiator 12, with the consequence that the rocket will not reach the ship 10, but will fly along a path shown on the drawing as a dotted line.

The jamming radiator 12 consists of a plurality of burning incendiary strips 13, and forms a jamming cloud of considerable infrared radiation intensity and considerable dimension. The incendiary strips burn off very slowly in a glowing manner and simultaneously sink down slowly. Therefore it is of importance that the jamming cloud 12 is established over the ship 10 in a moment and at a height such that the jamming cloud is located still at sufficient height over the ship and in sufficient distance from the ship when the rocket 11 arrives at the incenity of the ship 10; and of course the cloud then still must emit sufficient infrared radiation, i.e. an infrared radiation stronger than that of the ship. By means of the electronic equipments of today it is possible to determine exactly the most favourable position and the most favourable establishing time of the jamming cloud 12, the determination being based on the navigation data of the usual localizing apparatus of the ship 10 detecting the approaching object (rocket 11). In the practice the localizing apparatus of the ship 10 will be combined with an electronic computer which automatically effects the launching of the jamming projectile, which produces the jamming cloud as will be explained below.

Figure 2:
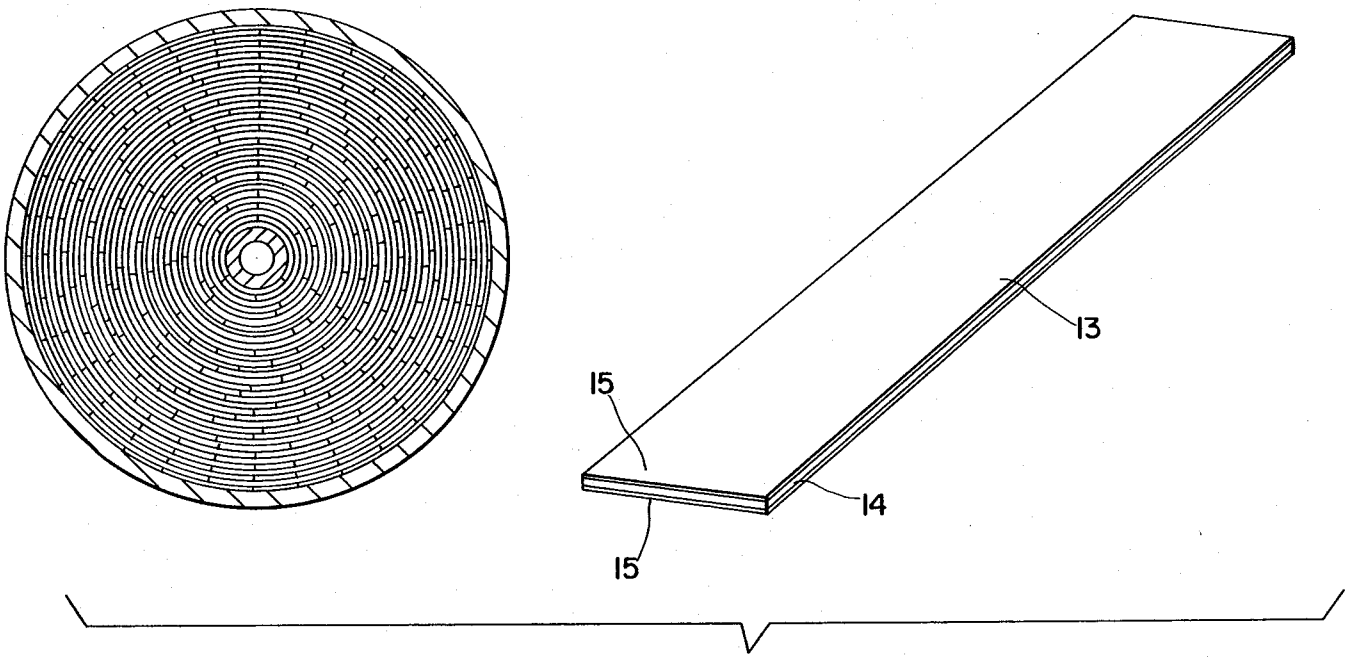
FIG. 2 is a perspective view, partially in cross-section of an incendiary strip.

In FIG. 2 there is displayed a single incendiary strip 13. This incendiary strip 13 consists of a foil strip 14 which is sandwiched between coatings 15. The foil strip 14 may be made of thin paper or thin metal foils, e.g. aluminum and may have a thickness of between about 0.1 and about 0.5 mm and a surface area between about 10 and about 100 $cm^2$. The coating 15 is made of a plastic paste such as polyvinyl chloride paste, a softening mass such as dioctyl phthalate, dispersion agents such as pure fuel and an incendiary substance. As incendiary substance a light-metal powder such as magnesium or aluminum or a light-metal-alloy powder or red phosphorus may be used. The combustibility may be strengthened by means of oxidixing substances such as inorganic nitrades or metal oxides. In order to obtain a slowly progressing glowing of the incendiary substance, the plastic substance and the oxidizing substance are mixed in an appropriate ratio. Preferably the amount of the incendiary substance is between 60 and 80 percent, the amount of the plastic substance is between 15 and 30 percent and the amount of the oxidizing substance is between 0 and 15 percent.

The viscosity of the mixture is adjusted by means of a dispersing agent in such a manner that the paste may be sprayed or brushed onto the foil strip 14. This vaporizing dispersing agent may be any suitable conventional agent such as gasoline for varying the viscosity of the paste. During the drying process, the gasoline vaporizes and volatizes and is thus useful in the production process rather than in the burning process. Having this paste brushed or sprayed onto the foil strip the coating is gelatinized at a temperature of 160° to 200° C. In order to obtain a coating as uniform as possible it is recommended at first to coat the foil strip 14 with a thin layer of plastic paste and to gelatinize it and thereafter to apply the actual incendiary substance. In doing so the coating will stick better to the carrier foil 14.

In case the foil strip 14 is made of paper in any case it will be consumed with the coating 15. On the other hand, when the foil strip 14 is made of metal such as aluminum, it is possible to choose by means by an appropriate adjustment of the incendiary substance whether the foil strip is consumed with the coating 15 or not. Under the condition that the burning of the coating 15 does not develop enough energy to ignite the metal foil strip 14, the strip stores the heat energy delivered by the burning of the incendiary substance.

The incendiary strips 13 are very light and therefore they sink down very slowly in the air; further the strips 13 in general are crease-proof whereby it is guaranteed that the strips 13 burn very slowly as desired.

Figure 3:
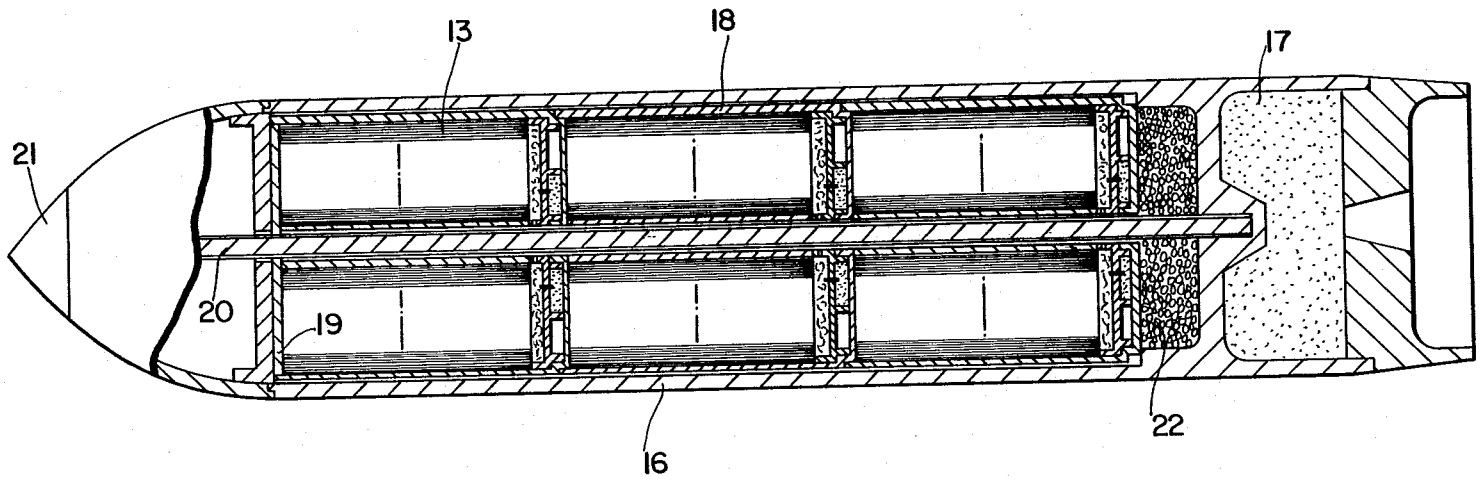
FIG. 3 is a cross-section taking along the longitudinal axis of the schematical view of a jamming projectile.

In FIG. 3 there is shown an embodiment of a jamming projectile 16 which produces the jamming cloud. The projectile 16 is provided with a rocket composition 17 and with three discharge containers 18, in which containers a plurality of incendiary strips 13 are housed.

The containers 18 are constructed such that the bottom of the containers may engage with the upper part of the container situated directly below. Only the uppermost container is closed by a cover 19. The connection between the containers 18 is of such strength only that the containers are held together during the discharge of the jamming projectile only. The discharge containers 18 are provided with a central bore which is passed through by a tube being filled with a fusing substance 20. This fuse 20 also connects the igniter 21 at the top of the projectile with the ejection charge 22 near the bottom of the projectile.

Figure 4:
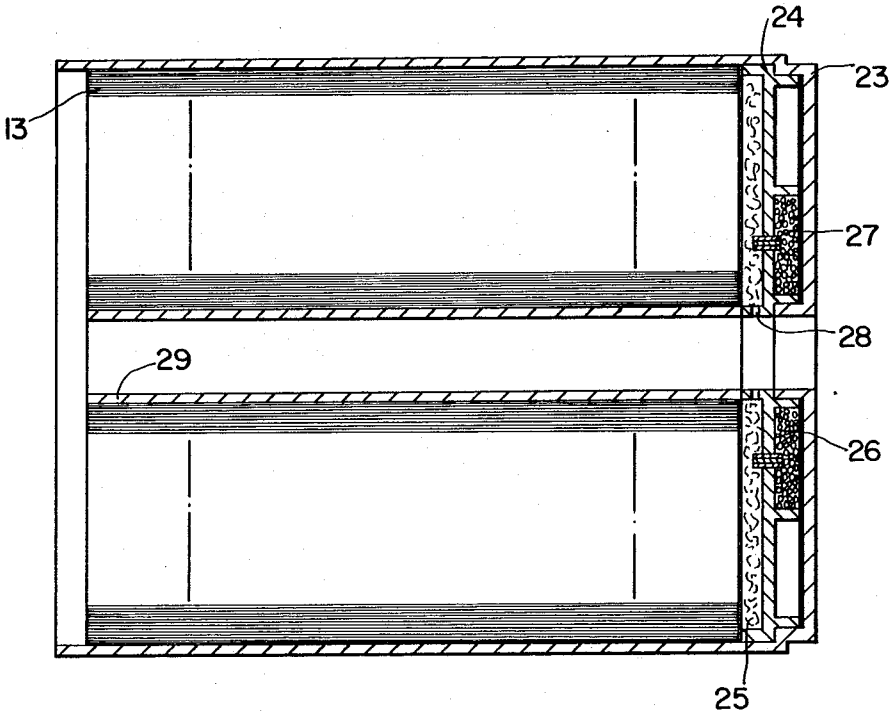
FIG. 4 is a longitudinal section through a discharge container.

In FIG. 4 there is shown the construction of a discharge container 18. On the bottom of a pot-like housing 23, having a central hole, there is situated a driving disk 24, one side of which, exactly that one which faces the incendiary strips, is provided with a secondary fuse 25, and which is provided on the opposite side with a discharge charge 26. The fuse 25 and charge 26 are connected via a delay charge 27. The secondary fuse 25 is connected with the central bore of the container by an incendiary hole 28. On the disk 24 there is fixed a tube 29, which contacts the bottom of the neighbouring container or the cover 19 if the container of interest is the top container.

The jamming projectile 16 is brought at the requested height by means of the rocket composition 17. When the projectile has reached the requested height, e.g. a height between 100 and 200 meters, the primary fuse 20 is ignited by means of the igniter 21. The primary fuse 20 ignites simultaneously the secondary fuse 25 via the holes 28 and the primary ejection charges 22. As a consequence the containers 18 are ejected in the direction of flight of the projectile and simultaneously the incendiary strips 13 are lighted by secondary fuse 25. After a short time-lag of 0.1 to 0.3 second the secondary ejection charges to are ignited by the charges 25 via the delay charges 27. Thus the primary fuse 20 simultaneously ignites the primary ejection charge 22 and the secondar fuse 25, the secondary fuse simultaneously igniting the strips 13 and the delay charges 27 (which in turn ignite the secondary ejection charges 26). During this process the pot-like housing 23 is pushed away backwards, the tube 29 lifting the pot-like housing of the adjoining container, or the cover 19 if the container of interest is the top container. The incendiary strips, now being completely exposed to the open air are distributed by the wind.

When the localizing apparatus of the ship 10 detects an approaching object, i.e. the rocket 11, the computer coupled with the localizing apparatus will effect the start of the jamming projectile 16 in response to the navigation data detected by the localizing apparatus, so that the projectile 16 starts in the right moment. Having reached an appropriate height vertically over or laterally over the ship 10 the projectile 16 emits the lighted strips 13, whereafter the slowly sinking burning incendiary strips 13 establish a jamming cloud of predetermined dimension. This burning cloud 12 emits an infrared radiation more intensive than that of the ship 10, so that the infrared finder of the approaching rocket 11 will be deflected from the ship 10 and will adjust itself to the cloud 12. As already told above the jamming cloud 12 must stay in the air until the rocket 11 has missed the ship 10, i.e. until the rocket 11 has passed the ship 10. An infrared jamming radiator which will provide the desired protection for a ship against approaching ordinance with infrared-sensitive target finders must (a) have a radiating area of a least 10-20 meters in diameter thus requiring wide dispersal of the particles; (b) have a radiation intensity higher than that of a ship, i.e., a temperature of several hundred degrees centrigrade because of the wide dispersal of the small particles, and (c) a relatively long duration, e.g., 1 minute. As a further practical requirement, the recognition of the target finders of such ordinance is generally limited to a fixed height above sea level, e.g. 80 meters. Since the one-minute burning duration must begin at that height and must terminate 20-30 meters above sea level, the particles must have an extremely low sinking velocity.

Of course the invention is not only usable for protection of ships but also for protection of other targets, e.g. airplane, tanks, buildings etc. The incendiary strips and the jamming projectile can be modified with respect to the used substances and the used construction elements. In the case of protecting airplanes it is possible to omit the rocket composition 17 in the projectile 16, with the result that the projectile 16 is used as a dropping bomb. In each case it is of importance that the jamming cloud is produced in such a distance from the target to be protected that the jamming cloud is recognized by the objective of the infrared finder of the approaching rocket, which finder is already adjusted to the target to be protected; further it is of importance that the intensity of the infrared radiation of the jamming cloud is higher than the intensity of the infrared radiation inherent in the target to be protected; finally it is of importance that the radiation duration of the jamming cloud is long enough as to let pass the rocket besides, over or under the target to be protected.

What is claimed is:

1. A method for the protection of surface targets against projectiles equipped with infrared sensitive target finders, comprising the steps of:

(a) detecting the approach of a projectile; and (b) providing an infrared jamming radiator in the airspace near the surface target in the form of a jamming cloud comprising a plurality of discrete burning foil particles each having a thickness between about 0.1 and 0.5 mm, a surface area between about 10 and 100 $cm^2$, and a shape and weight adapted for a slow rate of descent in the airspace, said foil particles being dispersed to provide an infrared radiating area at least as large as the surface target, the intensity of the infrared radiation from said cloud of burning particles being at least as great as that of the surface target over a time period at least as long as the active detecting time of the infrared sensitive target finder of the projectile.

2. The method of claim 1, wherein the discrete particles comprise foil strips coated on at least one side by a slow burning incendiary substance.

3. The method of claim 2, wherein the foil strips comprise a material combustible with the incendiary coating.

4. The method of claim 1, wherein the discrete particles comprise non-combustible metallic foil strips.

5. The method of claim 2, wherein the coating comprises a mixture of plastic paste, softening substance and incendiary substance.

6. The method of claim 5, wherein the mixture additionally contains a vaporizing dispersing agent.

7. The method of claim 5, wherein the coating contains at least 60% powder taken from the group consisting of phosphorus, light-metal powder and light-metal-alloy powder.

8. The method of claim 3, wherein the coating comprises a basis non-incendiary layer and a covering layer containing an incendiary substance.

9. A method for protecting surface targets against attack projectiles equipped with infrared sensitive target finders, comprising the steps of:

(a) detecting the approach of an attack projectile;

(b) emitting a jamming projectile from the target, the jamming projectile housing a plurality of incendiary strips each having a thickness between about 0.1 and 0.5 mm and a surface area between about 10 and about 100 $cm^2$;

(c) dispersing the plurality of incendiary strips into a cloud having dimensions not less than the dimensions of the surface target in the air space near the surface target upon the attainment of a predetermined distance from the target; and (d) igniting the strips to form an infrared jamming cloud having an infrared radiation intensity at least as great as that of the surface target.

* * * * *